US006217156B1

(12) United States Patent
Hawkins et al.

(10) Patent No.: US 6,217,156 B1
(45) Date of Patent: Apr. 17, 2001

(54) CONTINUOUS INK JET PRINT HEAD HAVING HEATER WITH SYMMETRICAL CONFIGURATION

(75) Inventors: Gilbert A. Hawkins, Mendon; James M. Chwalek, Pittsford; Constantine N. Anagnostopoulos, Mendon, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/334,810

(22) Filed: Jun. 17, 1999

(51) Int. Cl.[7] ..... B41J 2/05
(52) U.S. Cl. ..... 347/56
(58) Field of Search ..... 347/46, 54–57, 347/60–62, 66–67, 48

(56) References Cited

U.S. PATENT DOCUMENTS 5,812,159 * 9/1998 Anagnostopoulos et al. ..... 347/55
5,880,759 * 3/1999 Silverbrook ..... 347/55

* cited by examiner

*Primary Examiner*—John Barlow
*Assistant Examiner*—Juanita D. Stephens
(74) *Attorney, Agent, or Firm*—Milton S. Sales

(57) ABSTRACT

Apparatus for controlling an ink jet printer includes a substrate; an ink delivery channel below the substrate; and a nozzle bore through the substrate and opening into the ink delivery channel to establish an ink flow path. A resistive heater has an upper surface above the upper surface of the substrate and defines a symmetrical radially-outward heater perimeter edge. Ink tends to form a meniscus on the upper surface of the heater, the meniscus tending to pin at the heater perimeter edge. A plurality of electrodes make contact with the heater at spaced-apart positions below the perimeter edge. The ink may flow in a continuous stream from the nozzle bore. The heater defines a plurality of sections, each section having a pair of electrodes. The actuator is adapted to apply the power source across selected pairs of the electrodes such that actuation of only a portion of the heater sections produces an asymmetric application of heat to the stream to control the direction and the amount of deflection of the stream as a function of the activated heater sections.

9 Claims, 14 Drawing Sheets

CONTINUOUS INK JET PRINT HEAD HAVING HEATER WITH SYMMETRICAL CONFIGURATION

CROSS REFERENCE TO RELATED APPLICATIONS

Reference is made to commonly assigned, co-pending U.S. patent application Ser. No. 08/954,317 entitled CONTINUOUS INK JET PRINTER WITH ASYMMETRIC HEATING DROP DEFLECTION filed in the names of Chwalek, Jeanmaire, and Anagnostopoulos on Oct. 17, 1997.

FIELD OF THE INVENTION

This invention relates generally to the field of ink jet print heads in which there is drop ejection apparatus wherein a heater acts on a fluid or fluid meniscus of ink to be ejected.

BACKGROUND OF THE INVENTION

Ink jet printing has become recognized as a prominent contender in the digitally controlled, electronic printing arena because, e.g., of its non-impact low-noise characteristics, its use of plain paper, and its avoidance of toner transfers and fixing. Ink jet printing mechanisms can be categorized as either continuous ink jet or drop on demand ink jet.

Great Britain Patent No. 2,007,162, which issued to Endo et al. In 1979, discloses an electrothermal drop on demand ink jet printer which applies a power pulse to an electrothermal heater which is in thermal contact with water based ink in a nozzle. A small quantity of ink rapidly evaporates, forming a bubble which cause drops of ink to be ejected from small apertures along the edge of the heater substrate. This technology is known as Bubblejet™(trademark of Canon K.K. of Japan). U.S. Pat. No. 4,490,728, which issued to Vaught et al. In 1982, discloses an electrothermal drop ejection system which also operates by bubble formation to eject drops in a direction normal to the plane of the heater substrate. Rapid bubble formation provides the momentum for drop ejection.

Commonly assigned U.S. Pat. No. 5,880,759 which issued to Kia Silverbrook on Mar. 9, 1999, discloses a drop on demand liquid printing system wherein drop ejection is effected by selective actuation of a heater acting on the meniscus (the ink-air interface) of ink to be ejected. For this class of printer, the heater element may take the form of a ring or a part of a ring at the top surface of the print head. The top surface through which the orifices open generally defines an "orifice plane." The placement accuracy of ejected drops is influenced by the line of contact between the meniscus of the ink to be ejected and the top surface of the print head. If the contact line between the ink and the orifice surface is not symmetrically disposed about the orifice, the drops will not necessarily be ejected in a desired direction perpendicular to the orifice plane.

Continuous ink jet printing dates back to at least 1929. See U.S. Pat. No. 1,941,001 to Hansell. Conventional continuous ink jet utilizes electrostatic charging tunnels that are placed close to the point where the drops are formed in a stream. In this manner individual drops may be charged. The charged drops may be deflected downstream by the presence of deflector plates that have a large potential difference between them. A gutter (sometimes referred to as a "catcher") may be used to intercept the charged drops, while the uncharged drops are free to strike the recording medium.

U.S. Pat. No. 3,878,519, which issued to Eaton in 1974, discloses a method and apparatus for synchronizing droplet formation in a liquid stream using electrostatic deflection by a charging tunnel and deflection plates.

In another class of continuous ink jet printers, such as disclosed in commonly assigned, co-pending U.S. patent application Ser. No. 08/954,317 entitled CONTINUOUS INK JET PRINTER WITH ASYMMETRIC HEATING DROP DEFLECTION filed in the names of Chwalek, Jeanmaire, and Anagnostopoulos on Oct. 17, 1997, an ink jet printer includes a delivery channel for pressurized ink to establish a continuous flow of ink in a stream flowing from a nozzle bore in a direction of propagation related to the orifice plane. A heater having a selectively-actuated section associated with only a portion of the nozzle bore perimeter causes the stream to break up into a plurality of droplets at a position spaced from the heater. Actuation of the heater section produces an asymmetric application of heat to the stream to control the direction of the stream between a print direction and a non-print direction. The placement accuracy of ejected drops is influenced by the line of contact between the meniscus of the ink to be ejected and the surface of the orifice from which the drops are ejected. If the contact line between the ink and the orifice surface is not symmetrically disposed about the orifice, the drops will not necessarily be ejected in a desired direction perpendicular to the orifice plane.

For drop ejection apparatus in which a heater acts on the ink-air interface of ink to be ejected, the need to contact the heater electrically has made it difficult to provide a heater having sufficient symmetry to ensure that drops will be ejected in a direction perpendicular to the orifice plane. An electrical heater surrounds a central bore on a substrate. Electrical leads contact the heater so that the heater can be selectively operated. Ink wicking along the heater leads can distort the shape of the meniscus in the vicinity of the heater and can cause the drops to be ejected at an angle to the orifice plane if the wicking is not symmetrical.

DISCLOSURE OF THE INVENTION

It is an object of the present invention to provide a print head having an ink meniscus heater having sufficient symmetry to ensure that drops are ejected perpendicular to the orifice plane.

Accordingly, it is a feature of the present invention to provide apparatus for controlling an ink jet printer including a substrate; an ink delivery channel below the substrate; and a nozzle bore through the substrate and opening into the ink delivery channel to establish an ink flow path. A resistive heater has an upper surface above the upper surface of the substrate and defines a symmetrical radially-outward heater perimeter edge. Ink tends to form a meniscus on the upper surface of the heater, the meniscus tending to pin at the heater perimeter edge. A plurality of electrodes make contact with the heater at spaced-apart positions below the perimeter edge.

In one embodiment of the invention, the ink flows in a continuous stream from the nozzle bore. The heater defines a plurality of sections, each section having a pair of electrodes. The actuator is adapted to apply the power source across selected pairs of the electrodes such that actuation of only a portion of the heater sections produces an asymmetric application of heat to the stream to control the direction and the amount of deflection of the stream as a function of the activated heater sections.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
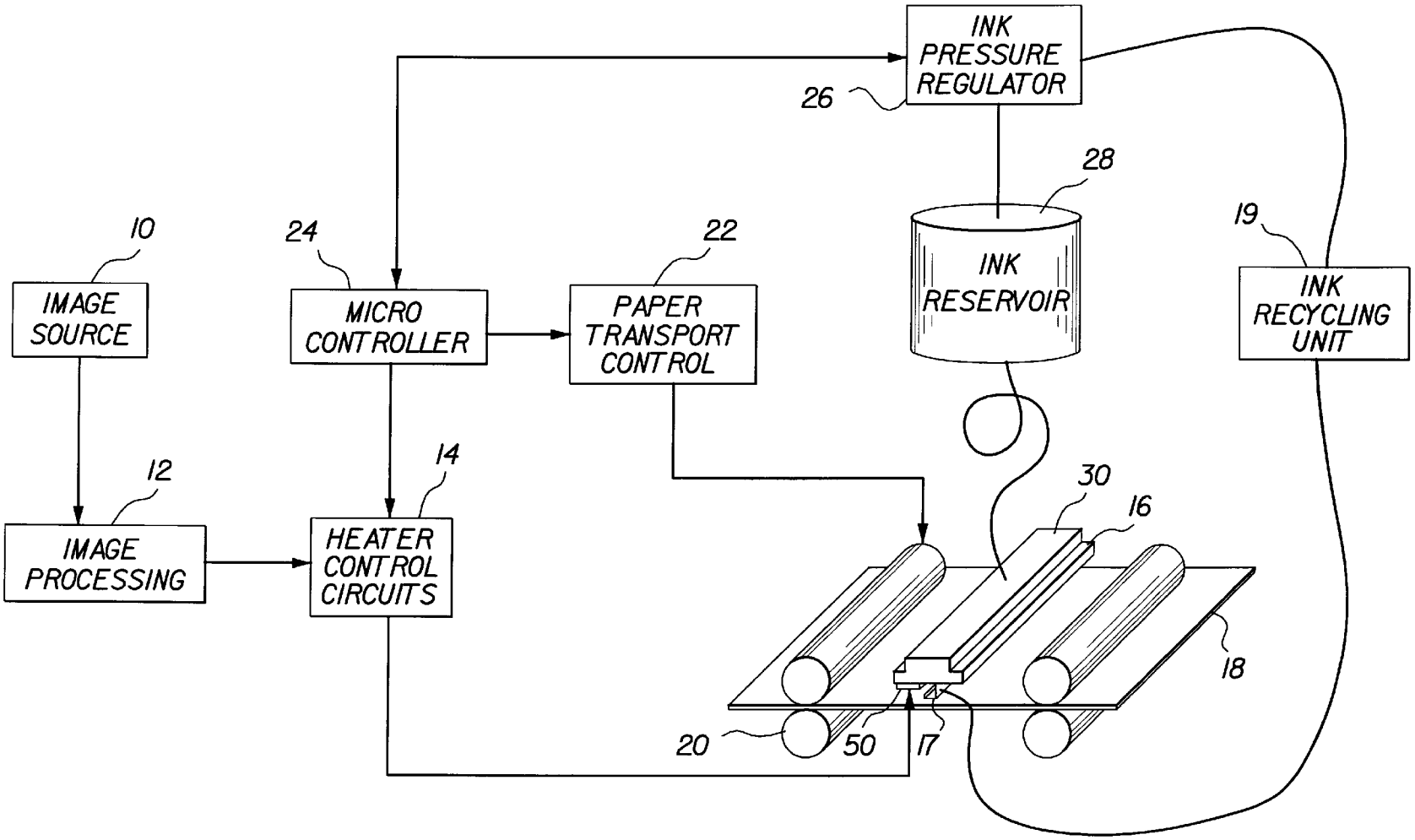
FIG. 1 shows a simplified block schematic diagram of one exemplary printing apparatus according to the present invention.

The present description will be directed in particular to elements forming part of, or cooperating more directly with, apparatus in accordance with the present invention. It is to be understood that elements not specifically shown or described may take various forms well known to those skilled in the art. While the invention is described below in the environment of a continuous ink jet printer, it will be noted that the invention can be used with drop on demand ink jet printers Referring to FIG. 1, a continuous ink jet printer system includes an image source 10 such as a scanner or computer which provides raster image data, outline image data in the form of a page description language, or other forms of digital image data. This image data is converted to half-toned bitmap image data by an image processing unit 12 which also stores the image data in memory. A plurality of heater control circuits 14 read data from the image memory and apply time-varying electrical pulses to a set of nozzle heaters 50 that are part of a print head 16. These pulses are applied at an appropriate time, and to the appropriate nozzle, so that drops formed from a continuous ink jet stream will form spots on a recording medium 18 in the appropriate position designated by the data in the image memory.

Recording medium 18 is moved relative to print head 16 by a recording medium transport system 20, which is electronically controlled by a recording medium transport control system 22, and which in turn is controlled by a micro-controller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width print heads, it is most convenient to move recording medium 18 past a stationary print head. However, in the case of scanning print systems, it is usually most convenient to move the print head along one axis (the sub-scanning direction) and the recording medium along an orthogonal axis (the main scanning direction) in a relative raster motion.

Ink is contained in an ink reservoir 28 under pressure. In the non-printing state, continuous ink jet drop streams are unable to reach recording medium 18 due to an ink gutter 17 that blocks the stream and which may allow a portion of the ink to be recycled by an ink recycling unit 19. The ink recycling unit reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of print head 16 by an ink channel device 30. The ink preferably flows through slots and/or holes etched through a silicon substrate of print head 16 to its front surface, where a plurality of nozzles and heaters are situated. With print head 16 fabricated from silicon, it is possible to integrate heater control circuits 14 with the print head.

Figure 2A:
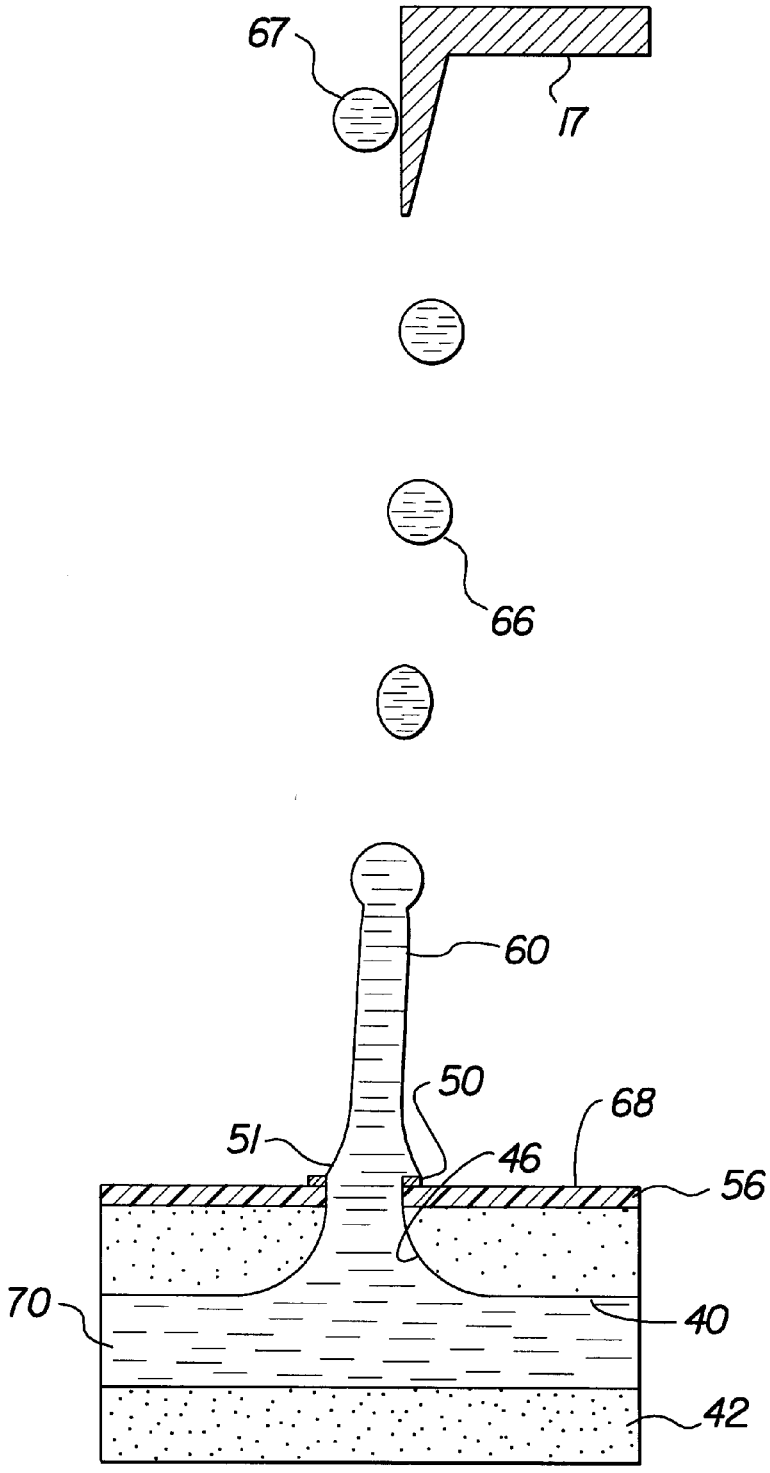
FIG. 2A shows a cross section of a nozzle with asymmetric heating deflection.
Figure 2B:
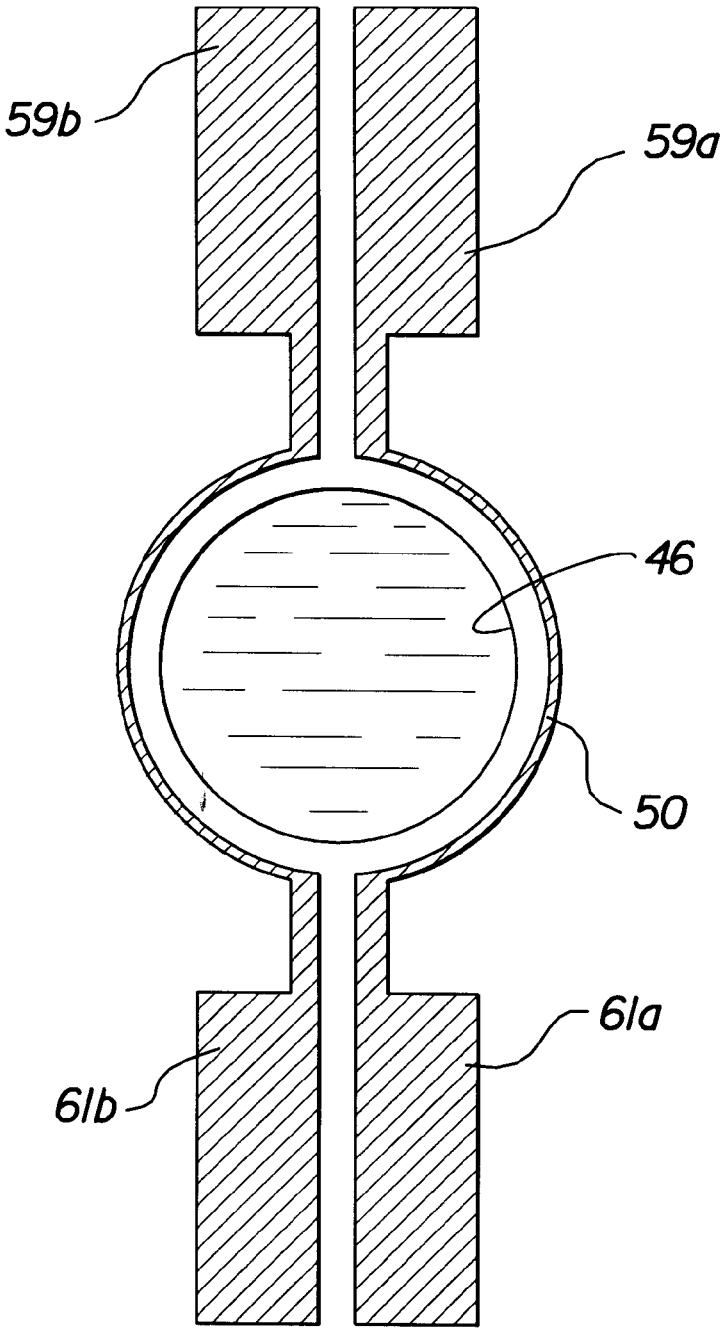
FIG. 2B shows a top view of the nozzle with asymmetric heating deflection.

FIG. 2A is a cross-sectional view of one nozzle tip of an array of such tips that form continuous ink jet print head 16 of FIG. 1 according the above-cited co-pending application Ser. No. 08/954,317. An ink delivery channel 40, along with a plurality of nozzle bores 46 are etched in a substrate 42, which is silicon in this example. Delivery channel 40 and nozzle bores 46 may be formed by anisotropic wet etching of silicon, using a $p^+$ etch stop layer to form the nozzle bores. Ink 70 in delivery channel 40 is pressurized above atmospheric pressure, and forms a stream 60. At a distance above nozzle bore 46, stream 60 breaks into a plurality of drops 66 due to a periodic heat pulse supplied by a heater 50. Referring to FIG. 2B, the heater of the above-cited co-pending application Ser. No. 08/954,317 has two sections, each covering approximately one-half of the nozzle perimeter. Power connections 59*a* and 59*b* and ground connections 61*a* and 61*b* from the drive circuitry to heater annulus 50 are also shown. Stream 60 (FIG. 2A) may be deflected by an asymmetric application of heat by supplying electrical current to one, but not both, of the heater sections. With stream 60 being deflected, drops 66 may be blocked from reaching recording medium 18 by a cut-off device such as an ink gutter 17. In an alternate printing scheme, ink gutter 17 may be placed to block undeflected drops 67 so that deflected drops 66 will be allowed to reach recording medium 18.

Figure 3:
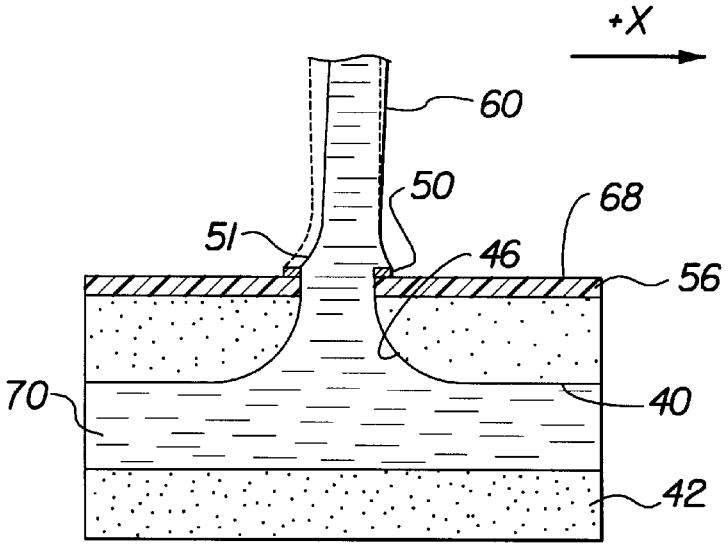
FIG. 3 is an enlarged cross section view of the nozzle with asymmetric heating deflection.

The heater was made of polysilicon doped at a level of about thirty ohms/square, although other resistive heater material could be used. Heater 50 is separated from substrate 42 by thermal and electrical insulating layers 56 to minimize heat loss to the substrate. The nozzle bore may be etched allowing the nozzle exit orifice to be defined by insulating layers 56. The layers in contact with the ink can be passivated with a thin film layer for protection. The print head surface can be coated with a hydrophobizing layer 68 to prevent accidental spread of the ink across the front of the print head. FIG. 3 is an enlarged view of the nozzle area of the above-cited co-pending application Ser. No. 08/954,317. A meniscus 51 is formed where the liquid stream makes contact with the heater edges. When an electrical pulse is supplied to one of the sections of heater 50 (the left-hand side in FIG. 3), the contact line that is initially on the outside edge of the heater (illustrated by the dotted line) is moved inwards toward the inside edge of the heater (illustrated by the solid line). The other side of the stream (the right-hand side in FIG. 3) stays pinned to the non-activated heater. The effect of the inward moving contact line is to deflect the stream in a direction away from the active heater section (left to right in FIG. 3 or in the +x direction). At some time after the electrical pulse ends the contact line returns toward the outside edge of the heater.

Figure 4A:
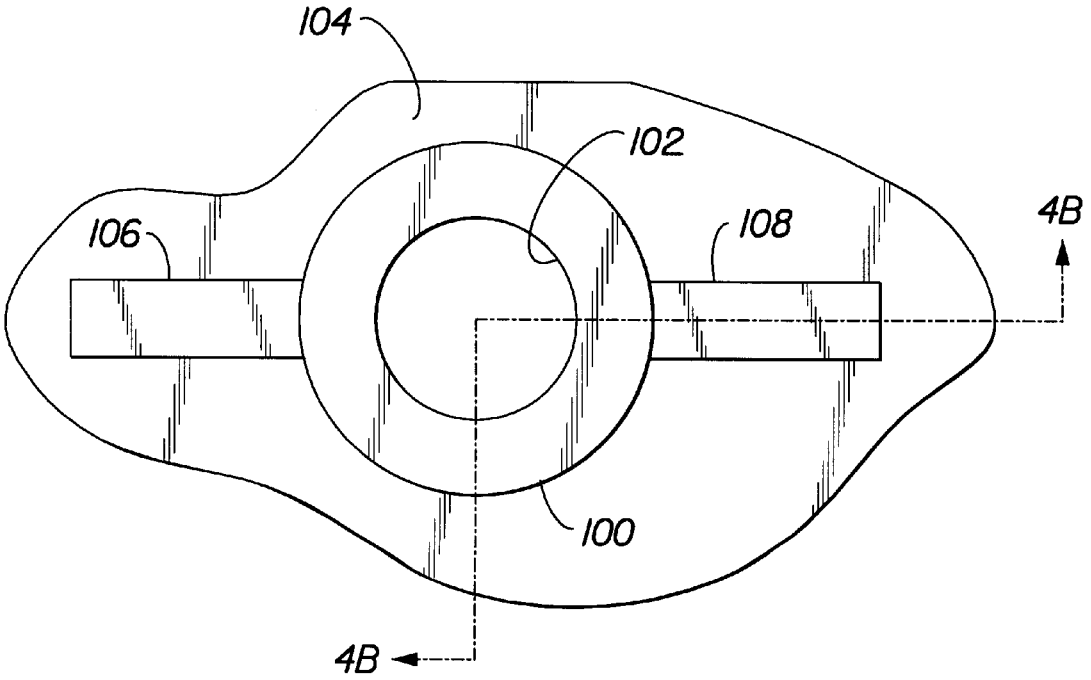
FIG. 4A (PRIOR ART)
FIG. 4A is a top view of a heater according to the prior art.
Figure 4B:
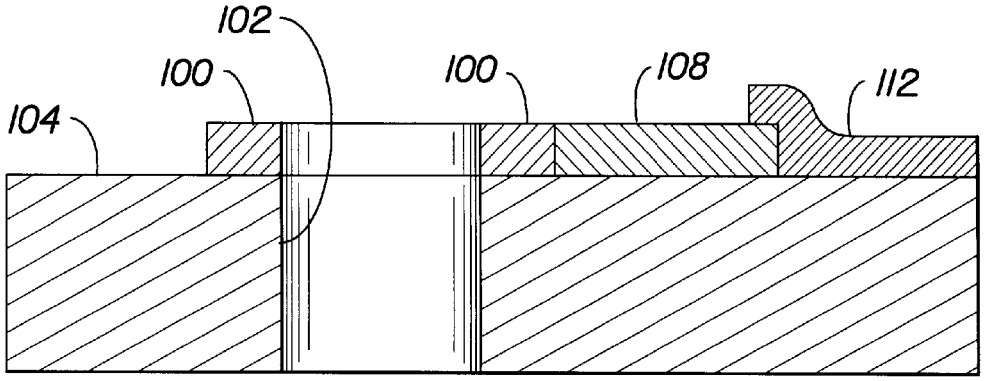
FIG. 4B (PRIOR ART)
FIG. 4B is a section view of a print head having the heater of FIG. 4A.
Figure 4C:
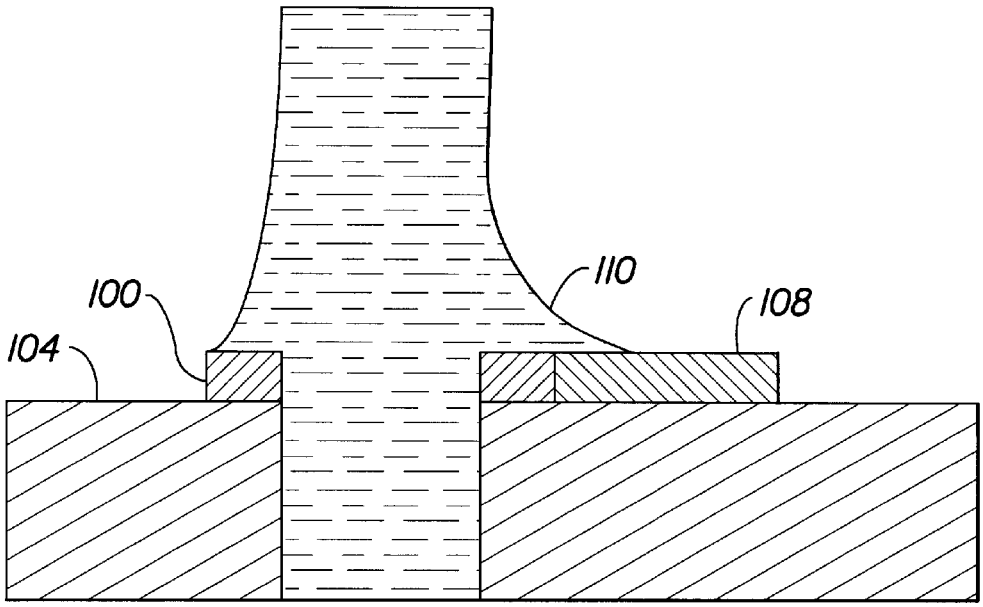
FIG. 4C (PRIOR ART)
FIG. 4C is an operational view of the print head of FIG. 4C.

For drop ejection apparatus in which a heater acts on the ink-air interface of ink to be ejected, the need to contact the heater electrically has made it difficult to provide a heater having sufficient symmetry to ensure that drops will be ejected in a direction perpendicular to the orifice plane. As shown in prior art FIGS. 4A–4C, an electrical heater 100 surrounds a central bore 102 on a substrate 104. The bore is an orifice through which ink flows. Electrical leads 106 and 108 contact the heater so that the heater can be selected operated. As best seen in FIG. 4C, ink wicking along the heater leads can distort the shape of the meniscus 110 in the vicinity of the heater and can cause the drops to be ejected at an angle if the wicking is not symmetrical. In the prior art drawings, heater leads 106 and 108 are contacted by a metal trace 112 (shown in FIG. 4B), as is well known in the art of semiconductor circuit fabrication. The contact to the trace is removed from vicinity the ink meniscus so that the trace does not contact the meniscus and plays no role in determining the shape of the heater where the heater contacts the meniscus.

Heater with Remote Trace

Figure 5A:
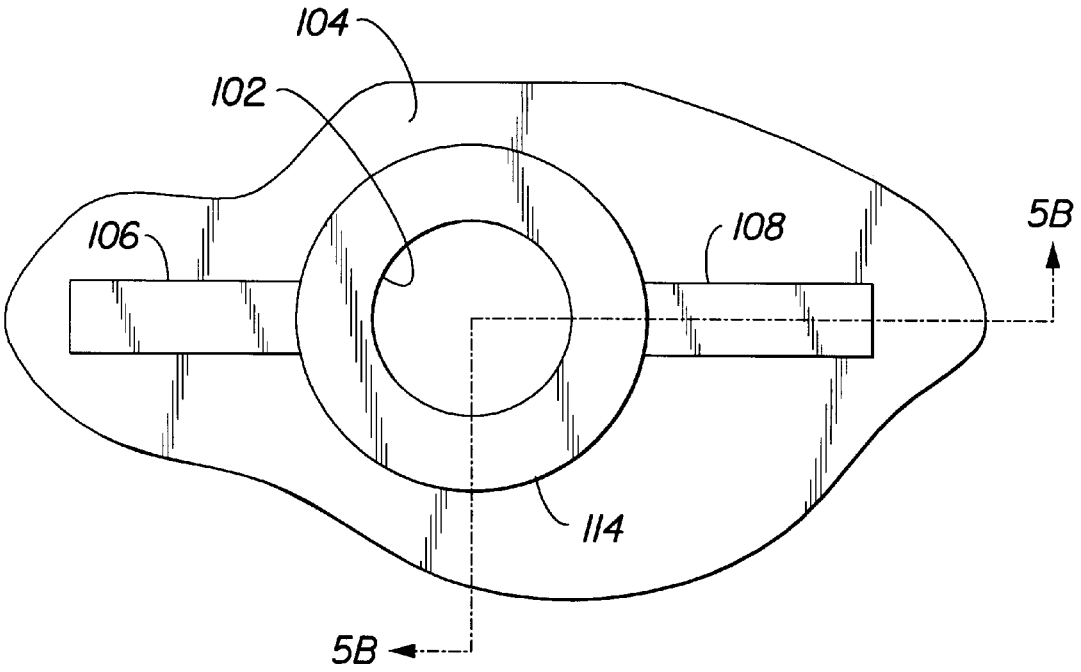
FIGS. 5A–5C are views similar to FIGS. 4A–4C according to the present invention.
Figure 5B:
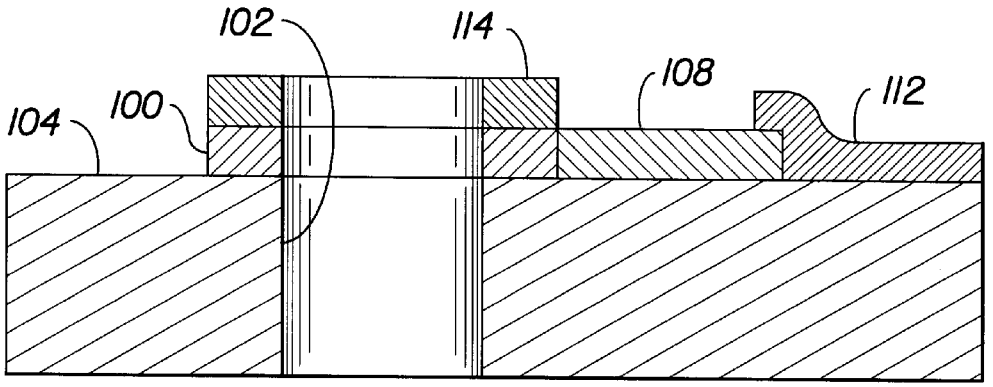
Figure 5C:
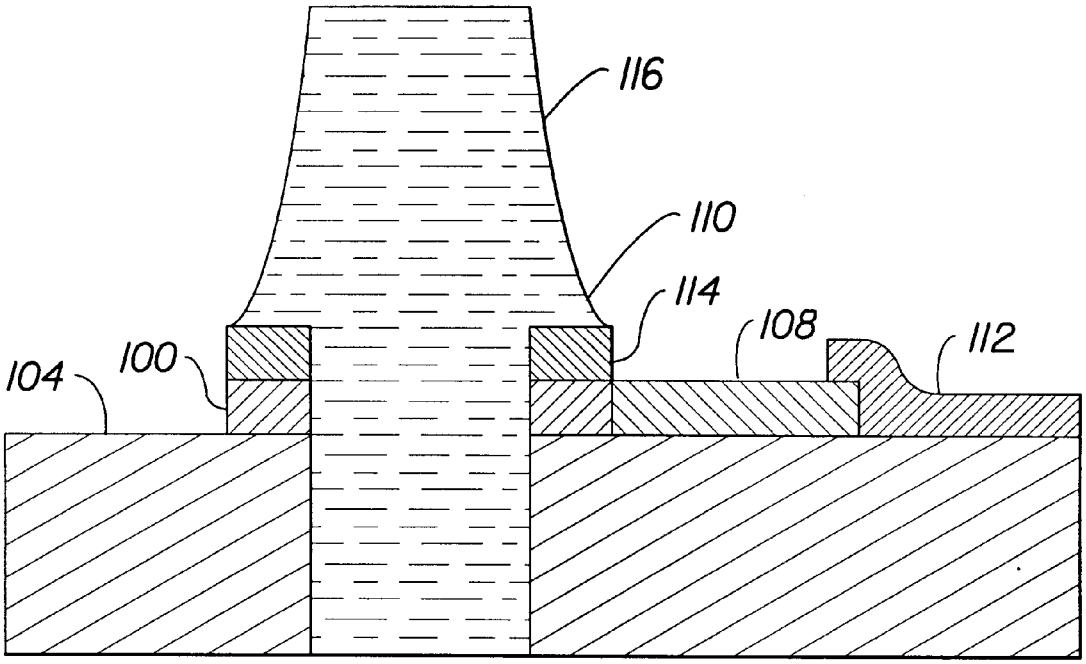

Referring to FIGS. 5A–5C, an electrical heater 100 is formed as an annulus such as by deposition, lithographic patterning and subsequent etching, or other methods such as described in U.S. Pat. No. 5,812,159. Heater 100 surrounds a central bore 102 on a substrate 104. The bore is an orifice through which ink flows. In the illustrated embodiment, the ink flows in a continuous stream, although the print head could be drop on demand. Electrical leads 106 and 108 contact the heater so that the heater can be selected operated. A dielectric ring 114 is aligned over electrical heater 100. FIG. 5C illustrates that the meniscus 110 of ink coulomb 116 contacts the upper surface of dielectric ring 114 in an axially symmetric manner. Thus, the direction of ink column propagation, in the illustrated case of continuous ink jet printing, is substantially perpendicular to orifice plate of the print head. The ink column, which will break into ink drops (not shown), and the ink drops themselves will move substantially perpendicular the orifice plane. In a non-illustrated embodiment of drop on demand printing, the direction of drop ejection is substantially perpendicular to orifice plane.

The method of fabrication of this device is advantaged in that dielectric ring 114 can serve as a mask during etching heater 100, and thus the dielectric ring is self-aligned to the heater. Electrical contact to heater leads 106 and 108 is made remotely from the heater by metal trace 112. The trace plays no role in determining the shape of heater 100 where the heater contacts the ink meniscus.

Figure 6:
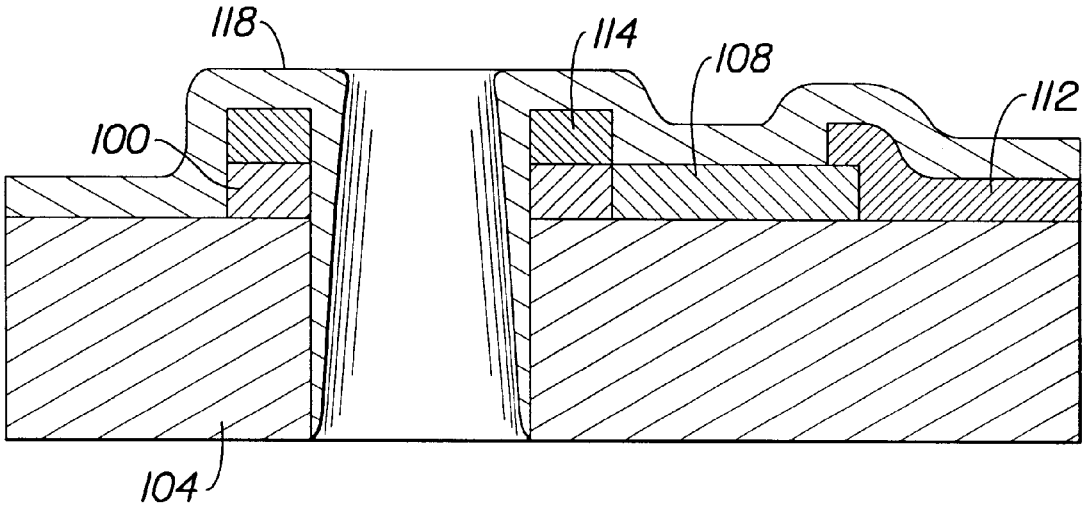
FIG. 6 is a view similar to FIG. 5C of an embodiment of a print head having a passivation layer.

FIG. 6 illustrates another configuration of the present invention, wherein a thin layer 118 of dielectric passivation material has been deposited over the top and sides of heater 100 such as by chemical vapor deposition, thermal evaporation, e-beam evaporation, sputtering, and spin-on techniques. The passivation material may be SiOx, $Si_3N_4$, SiC, Teflon™, $Ta_2O_5$, etc. The passivation material reduces or eliminates deposition of ink constituents on the heater or deterioration of the heater in the presence of ink when a voltage is applied to heat the ring. The direction of drop ejection in drop on demand printing or of ink column propagation in continuous ink jet printing remains substantially perpendicular to the orifice plate.

Heater with Underlying Trace

Figure 7A:
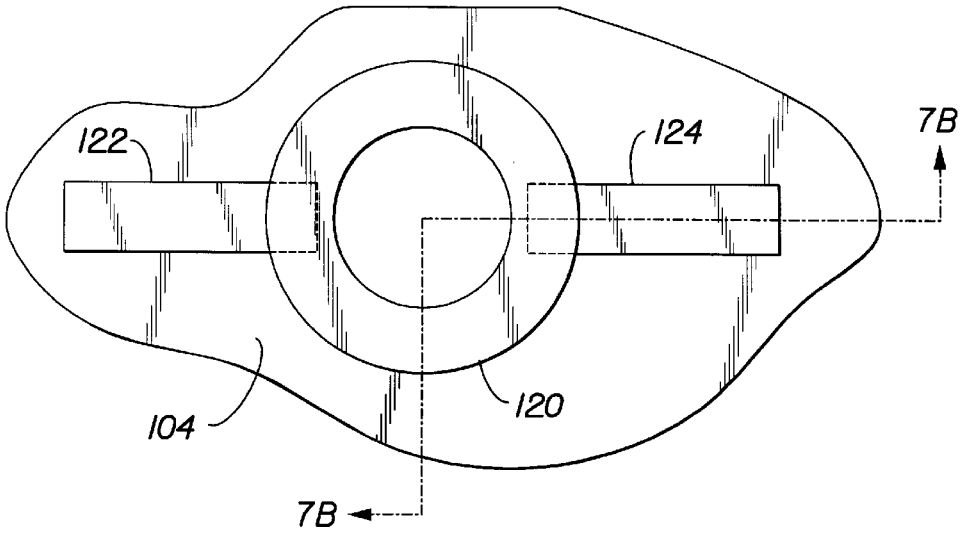
FIGS. 7A–7C are views similar to FIGS. 5A–5C according to another embodiment of the present invention.
Figure 7B:
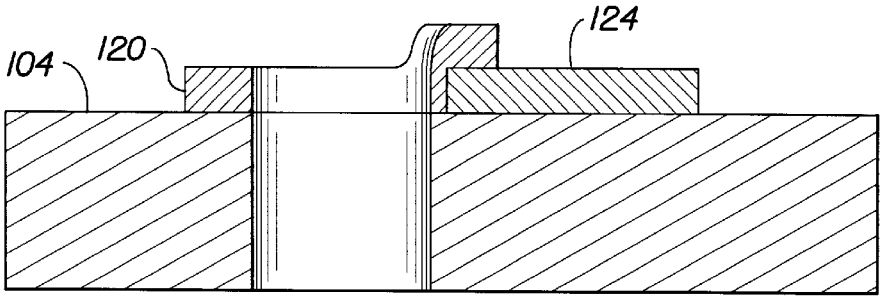
Figure 7C:
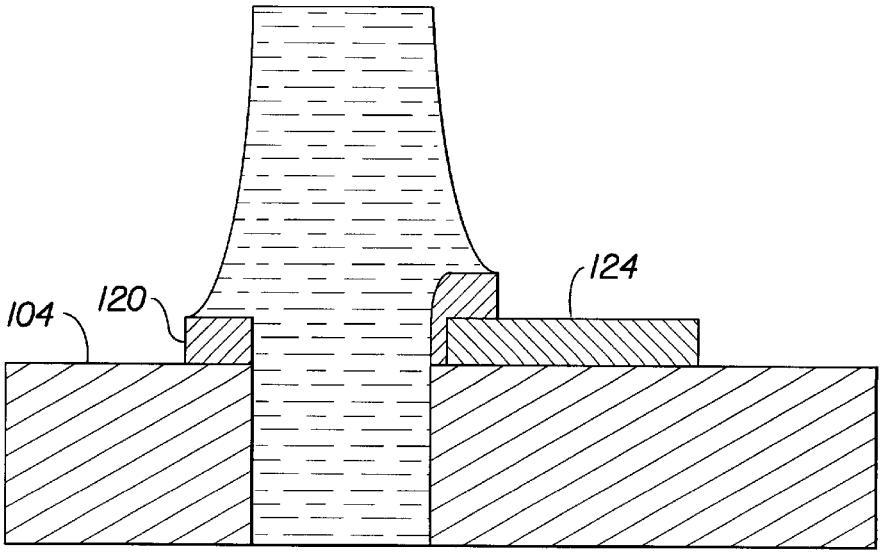
Figure 8A:
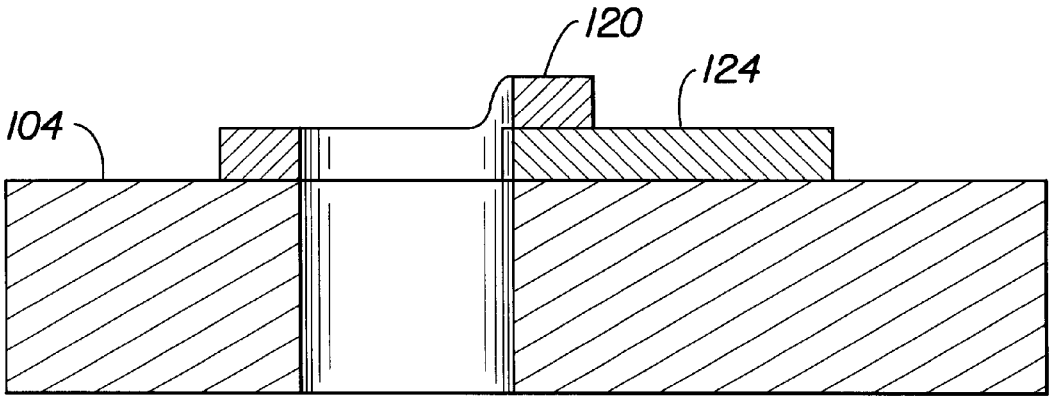
FIGS. 8A and 8B are views similar to FIGS. 5B and 5C of another embodiment of the present invention.
Figure 8B:
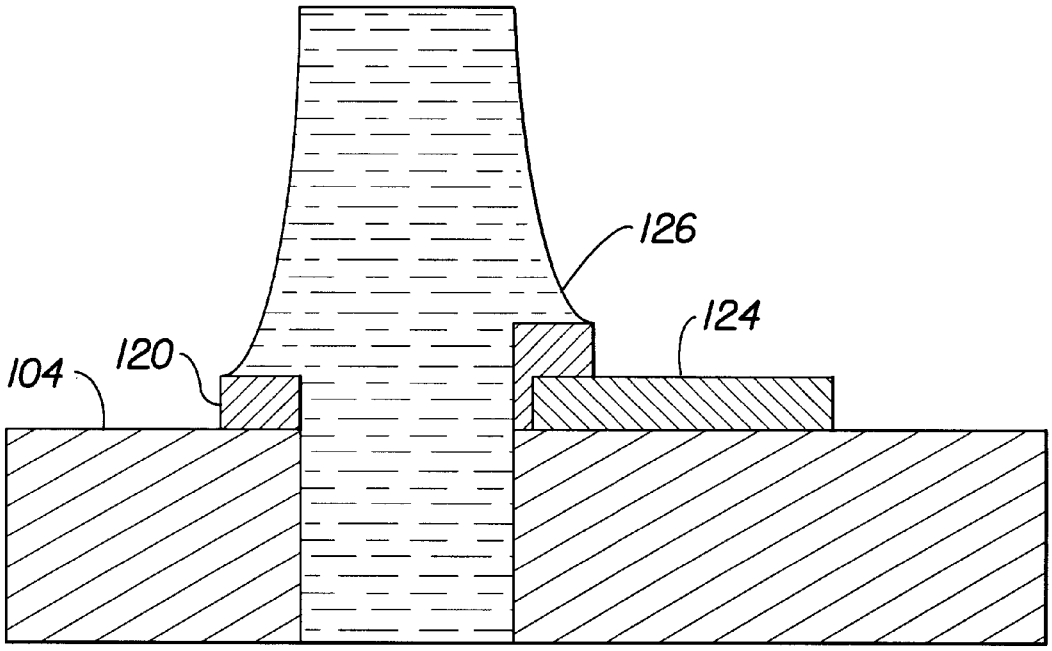

Although they provide a symmetrically disposed meniscus-to-heater contact line, the embodiments of FIGS. 5A–5C and 6 may not be optimal in all instances because of the large dielectric ring 114 material which resides over heater 100. This dielectric material may reduce thermal contact of the heater with the ink. Alternative embodiments, shown in FIGS. 7A–7C, 8A–8B, 9, and 10, provide more direct contact between a heater 120 and the ink in a manner which still avoids the wicking shown in FIG. 4C. In these embodiments of the present invention, heater 120 is formed as an annulus which overlays underlying a pair of metal traces 122 and 124. The heater may be provided so as to be offset with respect to the trace as illustrated in FIGS. 7A–7C or to be self-aligned to the trace as in FIGS. 8A and 8B. As shown in FIGS. 7C and 8B, for the case of continuous ink jet printing, an ink meniscus 126 contacting the heater is pinned to the outside edge of the heater and is symmetrically disposed around the heater. Although the outside edge of the heater is vertically higher in the regions where it overlies the traces than the portion of the heater in the region where it does not overlie the traces, the angle of the meniscus relative to the direction perpendicular to the orifice plane is very nearly uniform around the perimeter of the meniscus, as is well known to those skilled in the art of solid-fluid contact. Therefore, the difference in height does not cause a significant effect on the direction of drop ejection. This is true for the case in which heater is provided to be offset from the traces (FIG. 7C) or to be self-aligned to the traces (FIG. 8B).

The heater geometries described in the previous embodiments may be advantageously modified in at least two ways: (i) by offsetting the alignment between the edge of the heater and the edge of the bore and (ii) by incorporation of a dielectric passivation layer surrounding the heater, the trace, and the bore. These augmentations are discussed in relation to FIGS. 9 and 10, wherein an overlying dielectric passivation layers 128 and 130, respectively, are shown provided over the traces and heater and extending into the bore region. While incorporation of a dielectric passivation layer surrounding the heater alters both the flow of ink in the vicinity of the heater and the temperature of the ink in proximity to the heater, it serves to protect the heater from corrosion or deposition of ink components caused by heater operation.

Figure 9:
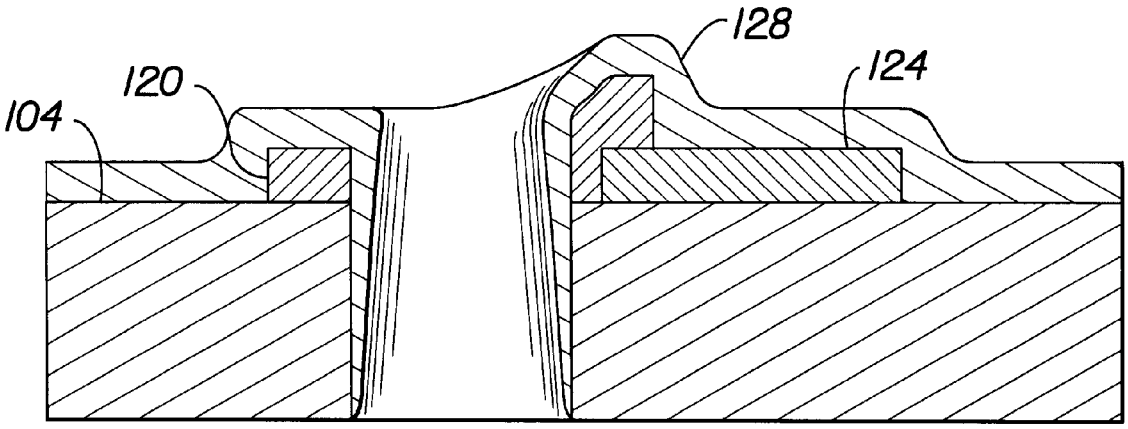
FIGS. 9 and 10 are views similar to FIG. 5C of an embodiment of a print heads of the embodiments shown in FIGS. 7A–7C and FIGS. 8A and 8B, respectively, having a passivation layer.
Figure 10:
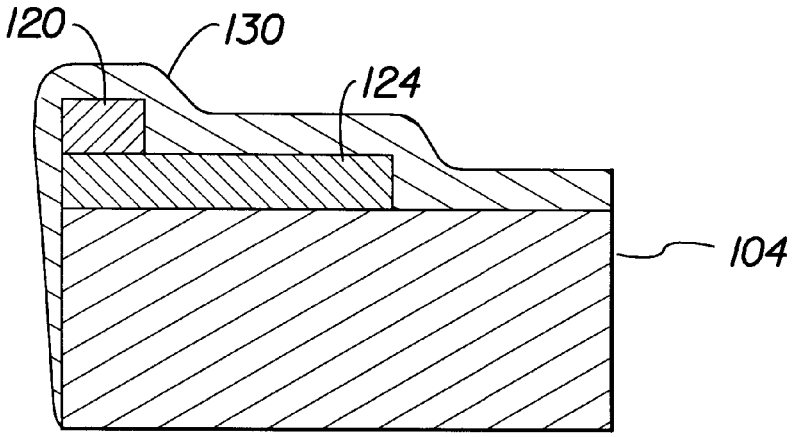

In FIG. 9, the traces are spaced away from the inner edge of the heater. The bore edge is aligned to the inner edge of the heater. In FIG. 10, the trace and inner edge of the heater are aligned to the bore edge. The incorporation of a dielectric passivation layer surrounding the heater affords control of the temperature of the ink in proximity to the heater and serves to protect the heater from corrosion or deposition of ink components caused by heater operation.

Heater with Inlaid Trace

Figure 11:
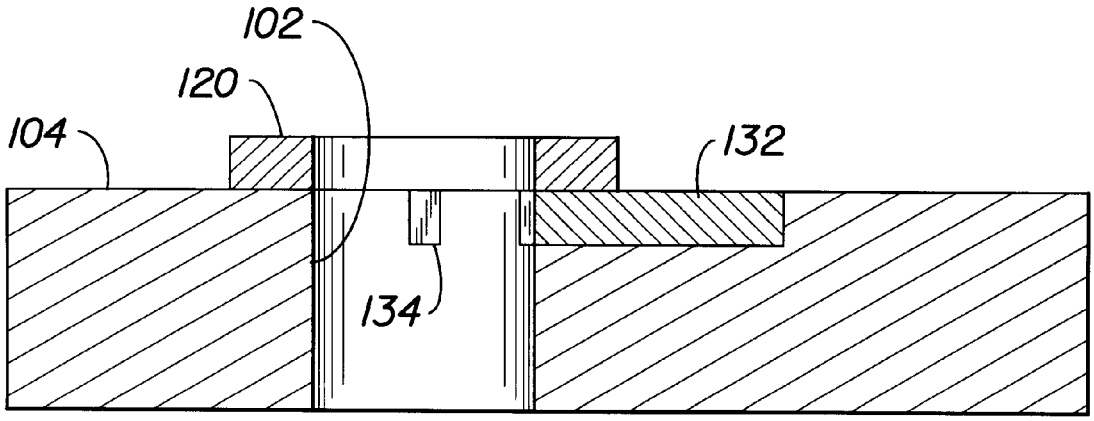
FIG. 11 is a cross section of a nozzle according to another embodiment of the present invention.
Figure 12:
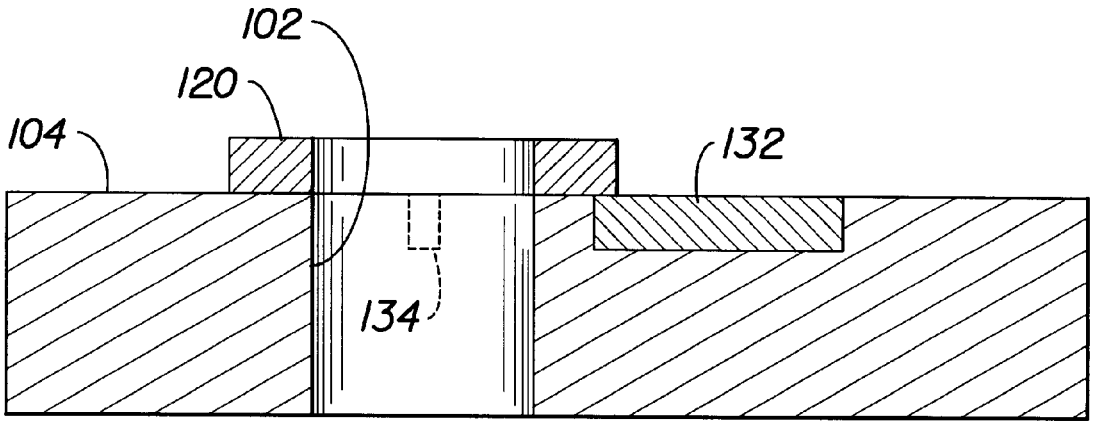
FIG. 12 is a cross section of a nozzle according to another embodiment of the present invention.

By providing a symmetrically disposed meniscus-to-heater contact line, the embodiments of FIGS. 7A–7C, 8A–8B, 9, and 10 may be further improved by making the surface of the heater entirely planar. In a related embodiment, shown in FIG. 11, planarity is achieved by inlaying a pair of traces 132 and 134 into substrate 104. Heater 120 is then provided entirely over the inlaid trace and has a planar upper surface. In FIG. 11, the inner edge of the heater is aligned to the edge of bore 102 and to the inner edge of the trace. In FIG. 12, the inner edge of the heater is aligned to the inner edge of bore 102 and the trace is offset from the inner edge of the heater. The geometry of FIG. 12 better protects the trace from corrosion due to the ink and reduces the conduction of heat to ink in the bore.

Figure 13A:
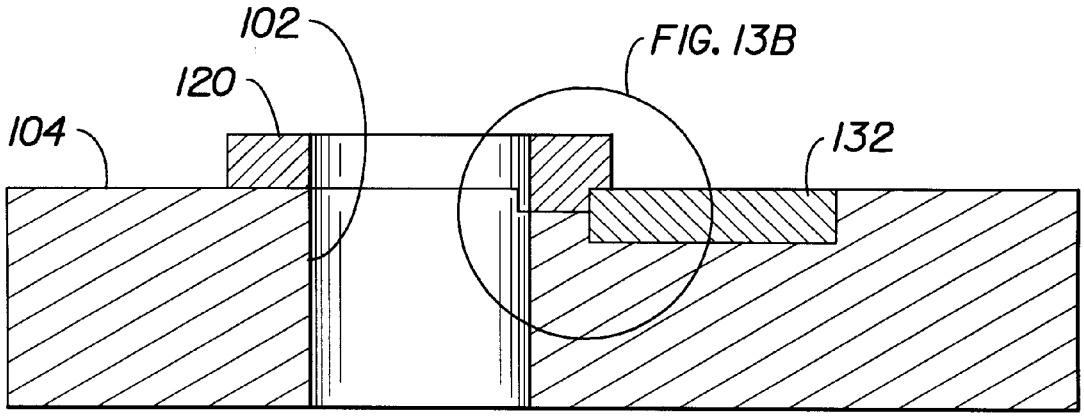
FIGS. 13A and 13B are cross section views of a nozzle according to another embodiment of the present invention.
Figure 13B:
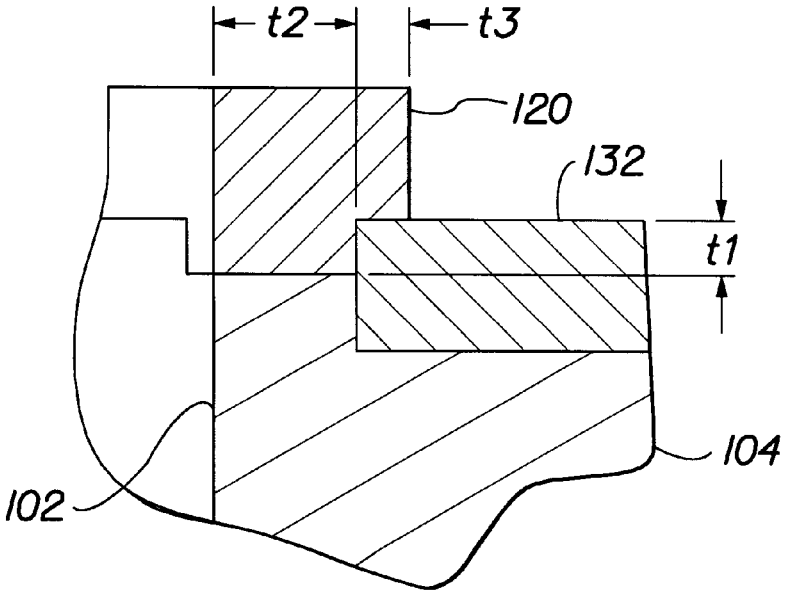

It is advantageous in the case of an inlaid trace to also partially inlay the heater into the trace, as shown in FIGS. 13A and 13B. The inside edge of heater 120 is offset a distance t2 away from the inside edge of bore 102, the outside edge of the heater is offset a distance t3 from the inside edge of the trace, and the bottom of the heater extends a distance t1 below the top of the inlaid trace.

Figure 14A:
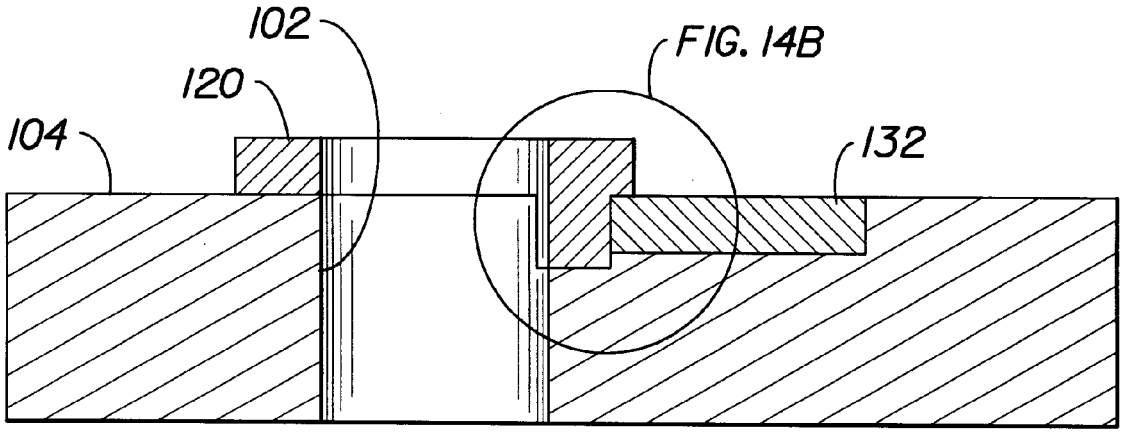
FIGS. 14A and 14B are cross section views of a nozzle according to another embodiment of the present invention.
Figure 14B:
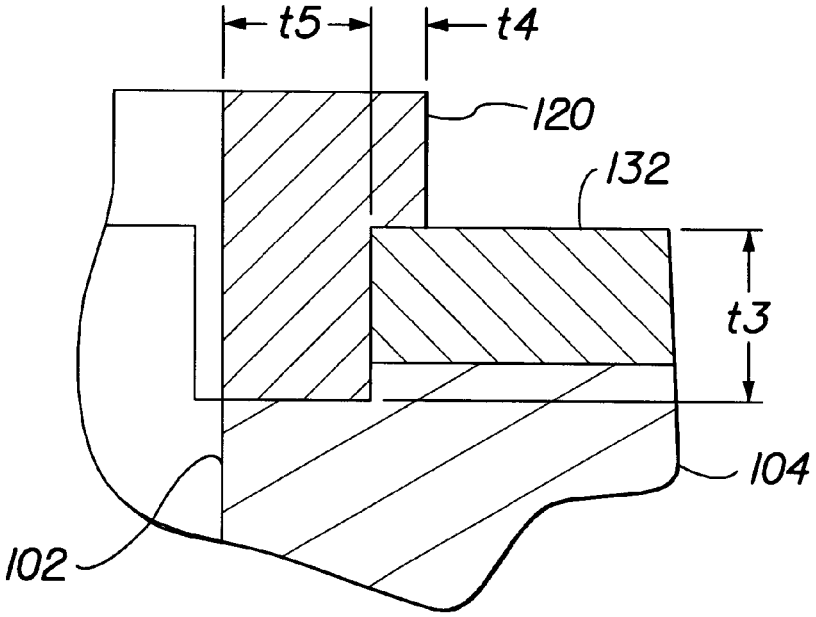
Figure 15A:
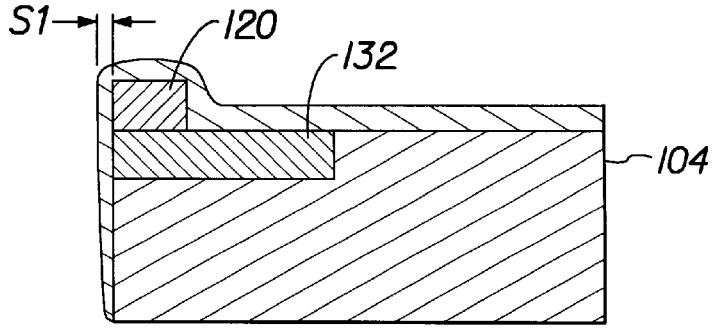
FIGS. 15A–15D are views similar to FIGS. 11, 12, 13A, 14A, respectively, including passivation layers.
Figure 15B:
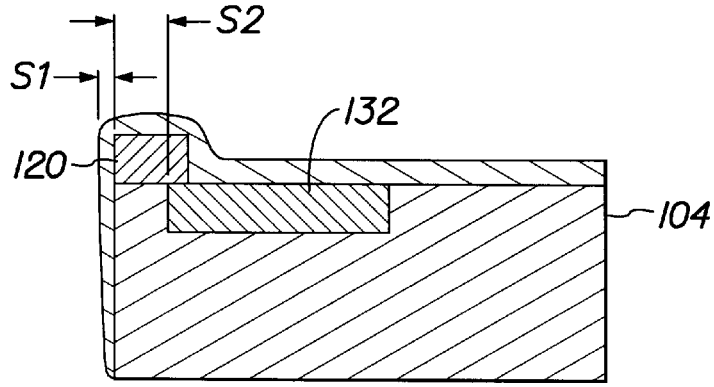
Figure 15C:
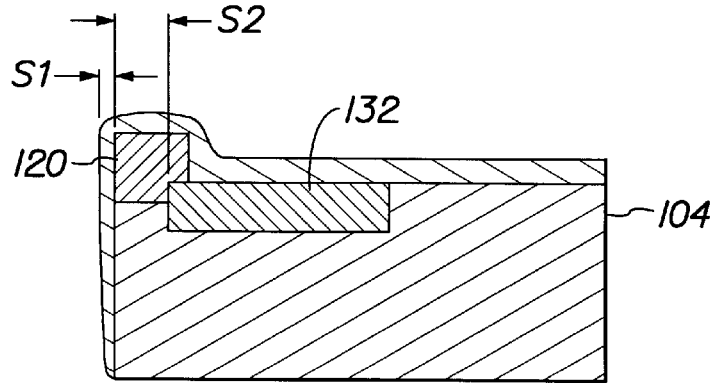
Figure 15D:
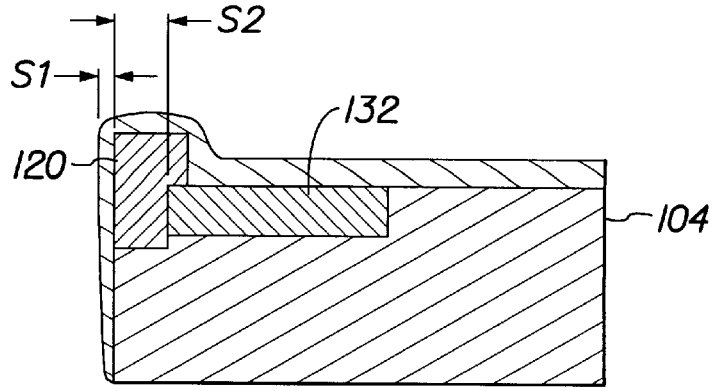

It is advantageous in other cases to partially inlay the heater material into the traces, as shown in FIGS. 14A and 14B, so that bottom of the heater extends below the bottom of the inlaid trace in order to fully protect the trace from ink and to provide the heater with a greater surface area of contact with the ink. The inside edge of the heater is offset a distance t5 away from the inside edge of the bore, the outside edge of the heater is offset a distance t4 from the inside edge of the trace, and the bottom of the heater extends a distance t3 below the top of the inlaid trace where t3 is greater than the thickness of the trace.

The inlaid traces with the heaters shown in FIGS. 11, 12, 13A, and 14A may additionally be protected from the corrosive effects of ink by providing at least one layer of dielectric passivation which extends into the bore. Such a passivation layer is shown in FIG. 15A–15D, respectively, as a deposited layer spaced a distance S1 from the inner edge of the bore. FIGS. 15A–15D correspond to cases where the heater is aligned, offset, or partially inlaid, respectively, in relation to the inlaid trace.

The invention has been described in detail with particular reference to preferred embodiments thereof, but it will be understood that variations and modifications can be effected within the spirit and scope of the invention.

What is claimed is:

1. Apparatus for controlling ink in an ink jet printer; said apparatus comprising:

a substrate having an upper surface;

an ink delivery channel below the substrate;

a nozzle bore through the substrate and opening below the substrate into the ink delivery channel to establish an ink flow path;

a resistive heater about at least a portion of the nozzle bore, said heater having an upper surface above the upper surface of the substrate and defining a symmetrical radially-outward heater perimeter edge;

a source of pressurized ink communicating with the ink delivery channel such that ink tends to form a meniscus on the upper surface of the heater, the meniscus tending to pin at the heater perimeter edge;

a plurality of electrodes contacting the heater at spaced-apart positions below the perimeter edge;

a power source; and an actuator adapted to apply the power source across pairs of the electrodes so as to activate said heater.

2. Apparatus for controlling ink in an ink jet printer as defined in claim 1 wherein the heater is annular.

3. Apparatus for controlling ink in an ink jet printer as defined in claim 1 wherein the heater is annular and uninterrupted.

4. Apparatus for controlling ink in an ink jet printer as defined in claim 1 wherein the heater is polysilicon doped at a level of about 30 ohms/square.

5. Apparatus for controlling ink in an ink jet printer as defined in claim 1 wherein:

the substrate comprises at least two dielectric layers; and the electrodes buried at the interface of the dielectric layers.

6. Apparatus for controlling ink in an ink jet printer as defined in claim 5 wherein the electrodes terminate radially outwardly of the bore.

7. Apparatus for controlling ink in an ink jet printer as defined in claim 5 wherein the electrodes extend radially only to the bore.

8. Apparatus for controlling ink in an ink jet printer as defined in claim 7 wherein the electrodes are covered by a passification layer at the bore.

9. Apparatus for controlling ink in an ink jet printer; said apparatus comprising:

a substrate having an upper surface;

an ink delivery channel below the substrate;

a nozzle bore through the substrate and opening below the substrate into the ink delivery channel to establish an ink flow path wherein the ink flows in a continuous stream from the nozzle bore;

a resistive heater about at least a portion of the nozzle bore, said heater having an upper surface above the upper surface of the substrate and defining a symmetrical radially-outward heater perimeter edge;

a source of pressurized ink communicating with the ink delivery channel such that ink tends to form a meniscus on the upper surface of the heater, the meniscus tending to pin at the heater perimeter edge;

a plurality of electrodes contacting the heater at spaced-apart positions below the perimeter edge wherein the heater defines a plurality of sections, each section having a pair of electrodes;

a power source; and an actuator adapted to apply the power source across selected pairs of the electrodes so as to activate said heater such that actuation of only a portion of the heater sections produces an asymmetric application of heat to the stream to control the direction and the amount of deflection of the stream as a function of the activated heater sections.

* * * * *